United States Patent [19]

Pulkkinen

[11] Patent Number: 4,695,188

[45] Date of Patent: Sep. 22, 1987

[54] LINED ROCK CISTERN OR TUNNEL

[75] Inventor: Jorma Pulkkinen, Porvoo, Finland

[73] Assignee: Neste Oy, Finland

[21] Appl. No.: 795,342

[22] PCT Filed: Mar. 8, 1985

[86] PCT No.: PCT/FI85/00024

§ 371 Date: Oct. 21, 1985

§ 102(e) Date: Oct. 21, 1985

[87] PCT Pub. No.: WO85/04214

PCT Pub. Date: Sep. 26, 1985

[30] Foreign Application Priority Data

Mar. 13, 1984 [FI] Finland ..... 841016

[51] Int. Cl.[4] ..... E21D 11/00

[52] U.S. Cl. ..... 405/150; 405/146

[58] Field of Search ..... 405/150, 151, 146, 36, 405/38

[56] References Cited

U.S. PATENT DOCUMENTS

| | | | |
|---|---|---|---|
| 1,876,205 | 9/1932 | Crom | 405/150 |
| 3,381,479 | 5/1968 | Curzio | 405/150 |
| 3,545,213 | 12/1970 | Sebor et al. | 405/150 |
| 3,625,010 | 12/1971 | Hakundy | 405/38 |
| 4,247,221 | 1/1981 | Lewer et al. | 405/150 |
| 4,388,357 | 6/1983 | Luebkc | 405/36 |
| 4,519,730 | 5/1985 | Horimatsu | 405/150 |
| 4,534,143 | 8/1985 | Goines et al. | 405/36 |
| 4,537,529 | 8/1985 | Fitz Simons | 405/150 |
| 4,576,511 | 3/1986 | Vidal, Jr. | 405/38 |
| 4,591,297 | 5/1986 | Horimatsu | 405/146 |

FOREIGN PATENT DOCUMENTS

| | | |
|---|---|---|
| 303027 | 10/1915 | Fed. Rep. of Germany . |
| 3223330 | 12/1983 | Fed. Rep. of Germany . |
| 75083063 | 5/1980 | Sweden . |
| 600135 | 6/1978 | Switzerland . |

*Primary Examiner*—Dennis L. Taylor

*Attorney, Agent, or Firm*—Steinberg & Raskin

[57] ABSTRACT

The present invention concerns a rock cistern or tunnel. The inner surface of the wall structure of the rock cistern is a tightly sealing lining. The supporting layer consists of a steel-reinforced water-tight sprayed concrete layer. Between the blasted rock surface and steel-reinforced water-tight sprayed concrete layer there is a sprayed concrete layer permeable to water, serving as a groundwater-conducting layer. In the sprayed concrete layer permeable to water, subdrain pipes have been placed. The tightly sealing lining consists of plastic, steel, fibre concrete or equivalent.

9 Claims, 2 Drawing Figures

LINED ROCK CISTERN OR TUNNEL

BACKGROUND OF THE INVENTION

The present invention concerns a rock cistern or tunnel with a tightly sealing lining for the inner surface of its wall structure and its supporting structure consisting of a steel-reinforced, water-tight sprayed concrete layer.

It is well-known practice to use caverns blasted in rock for storing various liquids and gases, without lining. In these cases the products to be stored are immiscible with water and lighter than water. That such liquids and gases are held in storage is based on the pressure of the water surrounding the rock cavern being higher than that of the product to be stored has. This has however the consequence that ground water flows into the place of storage. On the other hand, if the storing pressure of the liquid or gas is high, one is compelled to excavate unreasonably deep caverns, and this involves high costs. In cases in which no water contact of the product to be stored is permitted, lining of the storage walls is indispensable.

As to the state of art, reference is made to the European patent application No. 79101881.5 (publicizing No. 0007413), in which against the blasted rock surface there is a first concrete layer and against the inner surface of the wall structure, a second concrete layer. There is a protective layer and a tightly sealing film between these layers. A drawback of this kind of wall structure is that no anchors can be carried through said film. In addition, the percolating water collects between the first concrete layer and the film.

In the British Pat. No. 1,574,367 is disclosed a rock cistern wall structure of which the inner surface is a lining. This wall structure is composed of structural concrete elements to which the steel lining has been concreted fast. The design requires that there is an empty space for percolating water between the element and the blasted rock surface. This wall structure of the prior art is embarrassed by the drawback that the construction is extremely costly. Resistance against high inside pressure requires the use of thick steel sheet, which increases the price of the wall structure. A further drawback is its susceptibility to corrosion damage because the anchoring members have been carried through an empty space.

It is known in the art to coat the rock wall with sprayed concrete and to seal such a lining with plastic coatings. However, the successful applying of the methods of the prior art has been inhibited by the fact that the groundwater forces its way through the sprayed concrete lining and prevents adherence of the lining, and detaches the coating during use. Endeavors have been made to eliminate this by means of subdrains provided behind the sprayed concrete lining, which have the task to carry the harmful percolating water to a drain. Since the water only moves in fissures in the rock and such fissures are often highly abundant, the requisite drains would be so numerous that the required fixing of the concrete lining to the rock could no longer be provided.

SUMMARY OF THE INVENTION

The present invention concerns primarily the elimination of drawbacks caused by the groundwater and, consequently, the establishing of a tightly sealing surface and ensuring its perfect adherence to its base. On the other hand, the object of the invention is to unable the uneven rock surface after blasting to be smoothed so as to render possible the establishing of comparatively thick reinforced plastic linings.

The rock cistern or tunnel wall structure of the invention is mainly characterized in that there is, between the blasted rock surface and the steel-reinforced water-tight sprayed concrete layer, a sprayed concrete layer permeable to water and serving as a groundwater-conducting layer.

The novelty of the invention is the use of a sprayed concrete layer with good water conductivity as a layer eliminating the groundwater pressure, under the sprayed concrete layer proper. On the rock surface is sprayed a light-weight concrete mix, of which the constituents may be haydite, sand, cement and a puffing-up agent, or a water-conducting fibre, e.g. wood fiber, plastic fibre or glass fibre. This kind of light-weight concrete has a reasonable compressive strength 50 to 150 kp/cm$^2$, yet being permeable to water. From this layer it is easy to conduct the groundwater to the drains through plastic pipes. For the base of the actual sealed lining, a strong, tight, dry and sufficiently smooth concrete surface is needed, however. This can be produced with the aid of conventional sprayed concrete when the groundwater pressure has been efficiently eliminated between the rock and said surface.

Applications of the present invention are pressurized stores of natural gas under pressure, aviation kerosene stores, grain silos and stores and pressure tanks for various toxic substances.

The advantage of the lined cistern of the invention when used as a natural gas container is that the lined cistern may be built comparatively close to the soil surface (at 50–100 m depth), and that the cistern may be pressurized to a rather high pressure, whereas an equivalent unlined cistern would have to be sunk quite deep (at a minimum 500–1000 m). Thanks to the construction work close to the surface, the construction time will be shorter and the cost will be less.

An advantage of the cistern of the invention is also that the store can be built above the groundwater table. This would be contemplated when constructing cisterns in mountainous regions, for instance on the Norwegian, British and Japanese coasts.

An advantage of the lined rock cistern is further that the cistern can be built in comparatively low-strength and broken types of rock.

BRIEF DESCRIPTION OF THE DRAWINGS

The invention is described in detail, reference being made to an advantageous embodiment of the invention presented in the figures of the attached drawing, but to which the invention is not meant to be exclusively confined.

DESCRIPTION OF THE PREFERRED EMBODIMENTS

Figure 1:
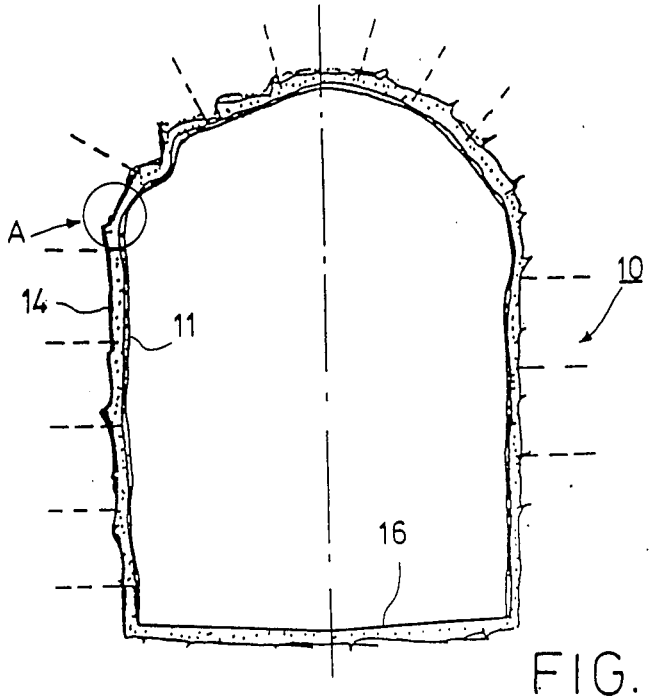
FIG. 1 presents in a schematic sectional view, an advantageous embodiment of the invention.
Figure 2:
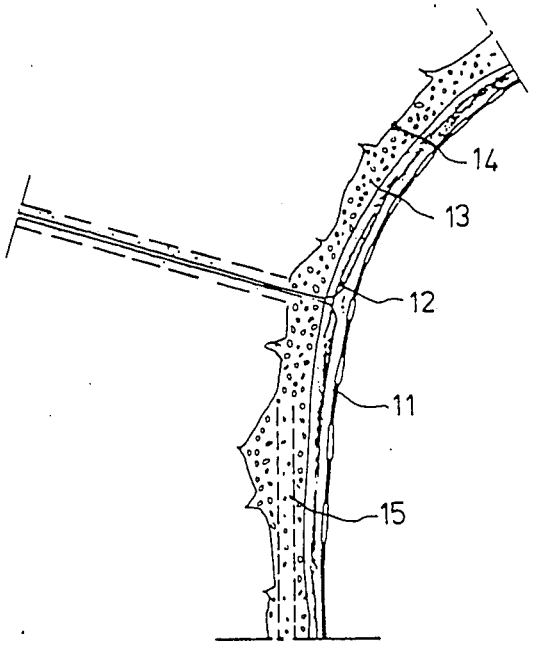
FIG. 2 shows the detail A of FIG. 1 on a larger scale.

In the embodiment depicted in FIGS. 1 and 2, the rock cistern or tunnel in general is indicated by the reference numeral 10. The inner surface 11 of the cistern 10 is a tightly sealing lining, in this embodiment a reinforced plastic layer. The bottom of the cistern 10 consists of a steel plate 16. The blasted rock surface is in FIG. 1 indicated with 14.

As can be seen in FIG. 2, against the reinforced plastic layer 11 there is placed a steel-reinforced water-tight sprayed concrete layer 12 serving as a supporting layer. As taught by the basic idea of the invention, there is between the blasted rock surface 14 and the reinforced water-tight sprayed concrete layer 12 a sprayed concrete layer 13 permeable to water, serving as a ground-water-conducting layer. The reference numeral 15 indicates subdrains, preferably plastic pipes, in the layer 13.

For the tightly sealing lining 11, various coatings may be used, such as plastic, steel, fibre concrete, etc. The bottom structure of the cistern 10 may, of course, be fully identical with the wall structure, but in the case of the bottom it is advantageous to use a steel plate 16, as has been indicated in FIG. 1, whereby a bottom structure of this type is strong enough e.g. to be walked on.

In the foregoing, only an advantageous embodiment of the invention has been presented, and it is obvious to a person skilled in the art that numerous modifications thereof are feasible within the scope of the inventive idea stated in the claims following below.

I claim:

1. A rock cistern or tunnel, comprising an inner layer of tightly sealing material, said inner layer having an inner surface facing the cistern or tunnel, and an outer surface, wherein said tightly sealing material is one of plastic, steel, or concrete fiber, an intermediate layer formed on said outer surface of said inner layer, said intermediate layer comprising a steel-reinforced, water-tight, sprayed concrete and said intermediate layer having an outer surface, an outer layer formed on said outer surface of said intermediate layer, said outer layer comprising water-permeable, sprayed concrete and serving as a layer for conducting ground water, wherein said water-permeable, sprayed concrete comprises a light-weight concrete mix of haydite, sand, cement, a swelling agent, or a water-conducting fiber.

2. The combination of claim 6, wherein said ground water conducting means comprise at least one drain pipe disposed in said outer layer.

3. The combination of claim 1, wherein a wall and a bottom of the cistern or tunnel are both formed of said three respective layers.

4. The combination of claim 1, wherein a lining at a bottom of the cistern or tunnel is formed of a steel plate.

5. The combination of claim 1, wherein said fiber is wood fiber, plastic, or glass fiber.

6. The combination of claim 1, wherein said water permeable, sprayed concrete has a compressive strength of about 50 to 150 kp/cm$^2$.

7. The combination of claim 1, wherein said cistern or tunnel being situated at a depth of about 50 to 100/m. below a surface of soil.

8. The combination of claim 2, wherein said ground water conducting means comprise a plurality of drain pipes in said outer layer.

9. The combination of claim 8, wherein said drain pipes are made of plastic.

* * * * *